US008485777B2

(12) United States Patent
Takemae et al.

(10) Patent No.: US 8,485,777 B2
(45) Date of Patent: Jul. 16, 2013

(54) BLOWER FAN UNIT

(75) Inventors: Motohiro Takemae, Kawasaki (JP); Shinichi Kobayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 650 days.

(21) Appl. No.: 12/719,941

(22) Filed: Mar. 9, 2010

(65) Prior Publication Data

US 2010/0290894 A1 Nov. 18, 2010

(30) Foreign Application Priority Data

May 15, 2009 (JP) ..... 2009-118809

(51) Int. Cl.
*F04D 29/46* (2006.01)

(52) U.S. Cl.
USPC ..... 415/127; 415/203; 415/204; 415/212.1; 415/213.1

(58) Field of Classification Search
USPC ..... 415/126, 127, 128, 150, 203, 204, 415/212.1, 213.1
See application file for complete search history.

(56) References Cited

U.S. PATENT DOCUMENTS

| | | | | |
|---|---|---|---|---|
| 6,027,406 | A * | 2/2000 | Yazici | 454/338 |
| 2010/0290894 | A1 * | 11/2010 | Takemae et al. | 415/126 |
| 2011/0182713 | A1 * | 7/2011 | Kobayashi | 415/126 |

FOREIGN PATENT DOCUMENTS

| | | | |
|---|---|---|---|
| JP | 06330884 | A * | 11/1994 |
| JP | 07055217 | A * | 3/1995 |
| JP | 2000297792 | A * | 10/2000 |
| JP | 2001295796 | A * | 10/2001 |
| JP | 2001355593 | A * | 12/2001 |
| JP | 2002-364597 | | 12/2002 |
| JP | 2004-44938 | | 2/2004 |
| JP | 2004-55656 | | 2/2004 |
| JP | 2007-278182 | | 10/2007 |
| JP | 2008-520104 | | 6/2008 |
| JP | 2008175168 | A * | 7/2008 |
| WO | 2006/055387 | | 5/2006 |

* cited by examiner

*Primary Examiner* — Edward Look
*Assistant Examiner* — Christopher R Legendre
(74) *Attorney, Agent, or Firm* — Staas & Halsey LLP

(57) ABSTRACT

A blower fan unit includes a housing, an impeller, an outlet, and a positioning mechanism. The impeller is mounted in the housing. The impeller rotates around a rotation center axis and generates an air current in a centrifugal direction from the rotation center axis. An outlet is formed in the housing and located in a centrifugal direction from the rotation center axis. A positioning mechanism is connected to the housing and makes the position of the housing change along the rotation center axis at each angular position around the rotation center axis.

13 Claims, 11 Drawing Sheets

BLOWER FAN UNIT

CROSS-REFERENCE TO RELATED APPLICATION

This application is based upon and claims the benefit of priority of the prior Japanese Patent Application No. 2009-118809, filed on May 15, 2009, the entire contents of which are incorporated herein by reference.

FIELD

The embodiments discussed herein are related to a technology for a blower fan unit that stirs air in a room.

BACKGROUND

For example, server computers are located in the room of the data center. For example, a blower fan unit is mounted on the top panel of the rack that accommodates the server computers. Air current generated by the blower fan unit stirs the air in the room. As a result, warm air with heat given off from the server computers mixes with relatively cold air surrounding the server computers. Thus, excessive temperature rise in the room of the data center is prevented.

The blower fan unit includes a centrifugal fan that rotates around a rotation center axis. The outlet is formed in a centrifugal direction from the rotation center axis in the housing that accommodates the centrifugal fan. The air current generated on the basis of driving the centrifugal fan is exhausted through the outlet. As a result, the housing rotates around the rotation center axis. The air current flows in a 360-degree circle around the rotating center axis. In the blower fan unit, the air current is only generated along an orthogonal virtual plane to the rotation center axis.

Japanese Laid-open Patent Publication No. 2007-278182, Japanese Laid-open Patent Publication No. 2002-364597, Japanese Laid-open Patent Publication No. 2008-520104, Japanese Laid-open Patent Publication No. 2004-55656 and Japanese Laid-open Patent Publication No. 2004-44938 are examples of related art.

SUMMARY

According to an aspect of the invention, a blower fan unit includes a housing, an impeller, an outlet, and a positioning mechanism. The impeller is mounted in the housing. The impeller rotates around a rotation center axis and generates an air current in a centrifugal direction from the rotation center axis. An outlet is formed in the housing and located in a centrifugal direction from the rotation center axis. A positioning mechanism is connected to the housing and makes the position of the housing change along the rotation center axis at each angular position around the rotation center axis.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Figure 1:
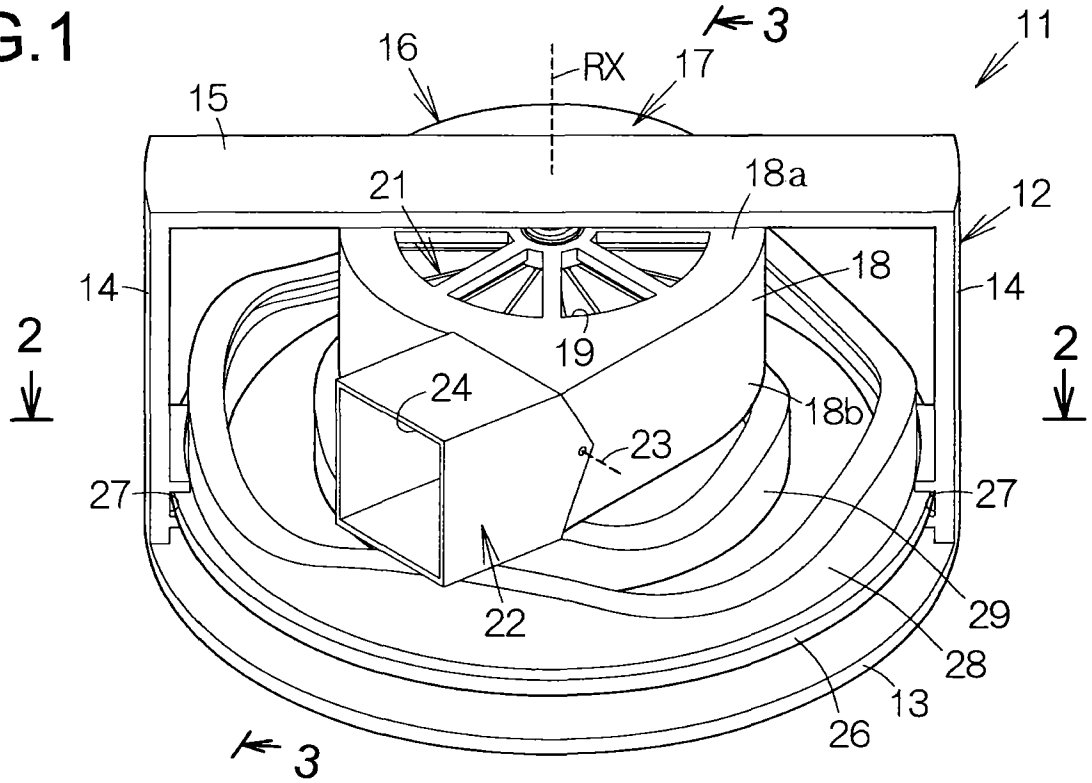
FIG. 1 is a perspective view that schematically illustrates the structure of a blower fan unit according to a first embodiment.

FIG. 1 is a perspective view that schematically illustrates the structure of a first blower fan unit 11 according to a first embodiment. The first blower fan unit 11 includes a support stand 12. For example, the support stand 12 includes a circular first base 13 having flat bottom surface. The support stand 12 includes a couple of columns 14 standing from the surface of the first base 13. The columns 14 face each other. The support stand 12 includes a support plate 15 which connects between the columns 14. For example, the support plate 15 extends in parallel with the surface of the first base 13. For example, the first base 13, the columns 14, and the support plate 15 are formed with a metallic material.

A blower fan 16 is hung from the support plate 15. The blower fan 16 includes a housing 17. As mentioned below, the housing 17 is rotatably connected to the support plate 15 of the support stand 12 around a rotation center axis RX perpendicular to the surface of the first base 13. For example, the housing 17 includes a housing body 18 having the accommodation space of a circular cylindrical shape. An inlet 19 is formed on the top panel 18*a* of the housing body 18 of the housing 17. The inlet 19 connects inside the accommodation space of the housing body 18 to outside space of the housing body 18 each other. An impeller 21 is accommodated in the accommodation space of the housing body 18. An enclosure wall 18*b* is located outside in the centrifugal direction from the rotation center axis RX.

The housing 17 includes an exhaust tube 22 that is connected with the outer surface of the enclosure wall 18*b* of the housing body 18. For example, the exhaust tube 22 is formed into a rectangular cylinder shape. One end of the exhaust tube 22 is connected with the housing body 18. The exhaust tube 22 swings around a swinging shaft 23 that is located on a virtual plane perpendicular to the rotation center axis RX. That is, the swinging shaft 23 is located in parallel with the surface of the first base 13. An outlet 24 is formed at the other end of the exhaust tube 22. The direction of the exhaust tube 22 changes on the basis of swinging around the swinging shaft 23. The outlet 24 is located outside in the centrifugal direction from the rotation center axis RX. For example the exhaust tube 22 is formed with a resin material.

For example, a circular second base 26 (corresponding to a base in the claims) is located on the surface of the first base 13. The surface of the second base 26 is formed into a flat surface that extends along a horizontal plane. The surface of the second base 26 faces the bottom panel of the housing body 18. A center axis of the second base 26 agrees with the rotation center axis RX. The outer edge of the second base 26 is fitted into a support groove 27 formed in the inner surface of the column 14. The support groove 27 is extended in parallel with the surface of the first base 13. The second base 26 is swingably supported around the rotation center axis RX by the support groove 27 of the column 14 of the support stand 12. An annular outer peripheral wall 28 and an annular inner peripheral wall 29 stand from the surface of the second base 26 around the rotation center axis RX. The inner surface of the outer peripheral wall 28 and the outer surface of the inner peripheral wall 29 are separated at prescribed interval. The inside diameter of the outer peripheral wall 28 is formed larger than the outside diameter of the inner peripheral wall 29. The outer peripheral wall 28 and the inner peripheral wall 29 are concentrically formed.

Figure 2:
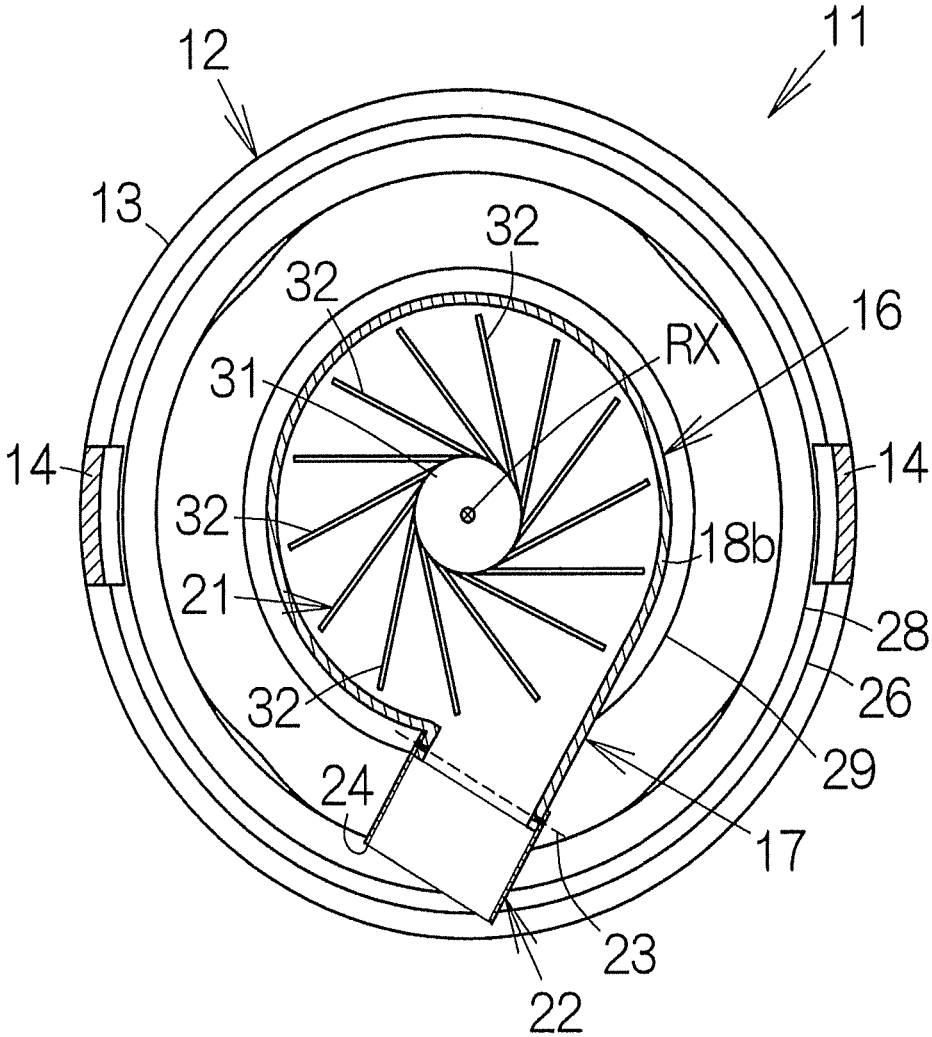
FIG. 2 is a cross-sectional view along 2-2 line of FIG. 1.

FIG. 2 is also referred. FIG. 2 is a cross-sectional view along 2-2 line of FIG. 1. The blower fan 16 is a centrifugal fan. The impeller 21 includes a rotating body 31 and a plurality of blades 32 radiating from the rotating body 31. The enclosure wall 18*b* extends along a virtual cylinder plane defined around the rotation center axis RX. The exhaust tube 22 extends along a virtual plane in contact with this virtual cylinder plane. Thus, the inner wall surface of the enclosure wall 18*b* faces the outer edge of the blades 32 of the rotating body 31. For example, the rotational speed of the impeller 21 is set to about 3000 rpm. The rotational speed of the impeller 21 may be constantly set, and may be variably set. When the impeller 21 rotates around the rotation center axis RX, the air flows into the inlet 19 along the rotation center axis RX. The air current is generated in centrifugal direction by the rotation of the impeller 21. The air current in centrifugal direction is induced to the exhaust tube 22 along the inner wall surface of the enclosure wall 18*b*.

Figure 3:
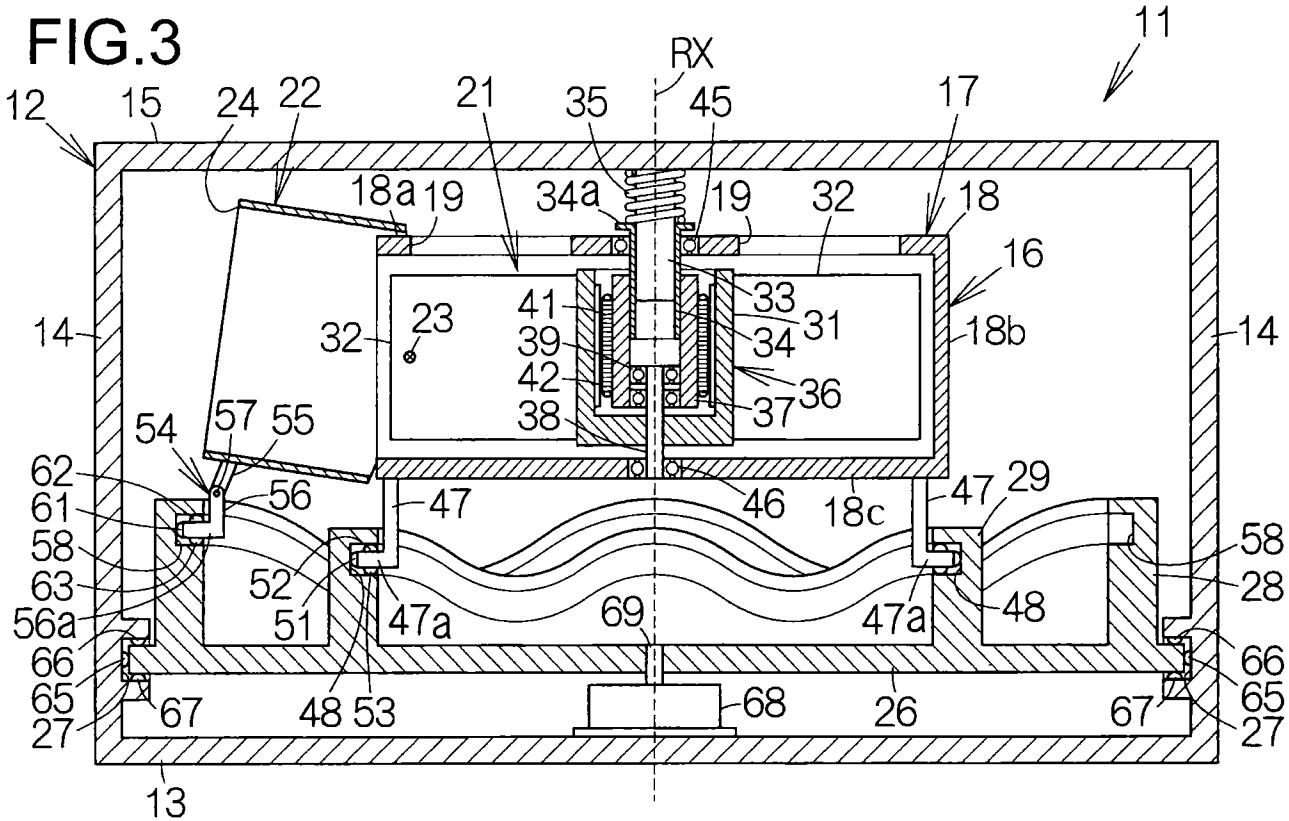
FIG. 3 is a cross-sectional view along 3-3 line of FIG. 1, and schematically illustrates that the housing is positioned at an uppermost position.

FIG. 3 is also referred. FIG. 3 is a cross-sectional view along 3-3 line of FIG. 1, and schematically illustrates that the housing 17 is positioned at an uppermost position. A support shaft 33 is mounted on the support plate 15. For example, the support shaft 33 is formed into a circular cylindrical shape. The shaft center of the support shaft 33 agrees with the rotation center axis RX. A pipe 34 having a circular cylindrical shape is formed around the lower part of the support shaft 33. The pipe 34 is connected to the support shaft 33 along the rotation center axis RX. However, the relative rotation of the pipe 34 to the support shaft 33 around the rotation center axis RX is restricted. A flange 34*a* radiating in centrifugal direction from the rotation center axis RX is formed on the top of the pipe 34. The elastic member (e.g., a coil spring) 35 is put between the flange 34*a* and the support plate 15. The coil spring 35 produces the elastic force that keeps away the flange 34*a* from support plate 15.

A first electric motor 36 is mounted at the lower part of the pipe 34. The first electric motor 36 includes a sleeve 37 of the circular cylindrical shape fixed to the lower part the pipe 34. The center of the pipe 34 and the sleeve 37 agree with the rotation center axis RX. Here, the sleeve 37 is a stator. A first rotation shaft 38 is rotatably supported by the sleeve 37 around the rotation center axis RX. The center of the first rotation shaft 38 agrees with the rotation center axis RX. For example, the first rotation shaft 38 is supported in a couple of first ball bearings 39. The rotating body 31 is fixed to the first rotation shaft 38. The blades 32 are mounted on the outer wall surface of the rotating body 31. The hollow space around the sleeve 37 is formed in the rotating body 31.

A plurality of the electromagnetic coils 41 and a permanent magnet 42 are mounted in the hollow space of the rotating body 31. The electromagnetic coil 41 is fixed to the outer wall surface of the sleeve 37. The permanent magnet 42 is fixed to the inner wall surface of the rotating body 31 opposite to the outer wall surface of the sleeve 37. The electromagnetic coils 41 are opposite to the permanent magnet 42. The rotating body 31 rotates around the rotation center axis RX on the basis of the repulsion between the magnetism generated with the electromagnetic coils 41 and the magnetism of the permanent magnet 42 when electric power is supplied to the electromagnetic coils 41. The center of the rotating body 31 agrees with rotation center axis RX. When the electric power is supplied to the electromagnetic coils 41, a wiring (not illustrated) to pass through the pipe 34 and the support shaft 33 is used.

Penetration holes are formed in the top panel 18*a* and in the bottom panel 18*c* of the housing body 18 along the rotation center axis RX. A second ball bearing 45 is fixed in the penetration hole of the top panel 18*a*. Thus, the top panel 18*a* is connected to the pipe 34 by the second ball bearing 45. Similarly, a third ball bearing 46 is fixed in the penetration hole in the bottom panel 18*c*. Thus, the bottom panel 18*c* is connected to the first rotation shaft 38 by the third ball bearing 46. As a result, the housing body 18 of the housing 17 is rotatably connected to the pipe 34 and the first rotation shaft 38 around the rotation center axis RX. That is, the housing 17 is rotatably connected to the support shaft 33 around the rotation center axis RX.

Figure 4:
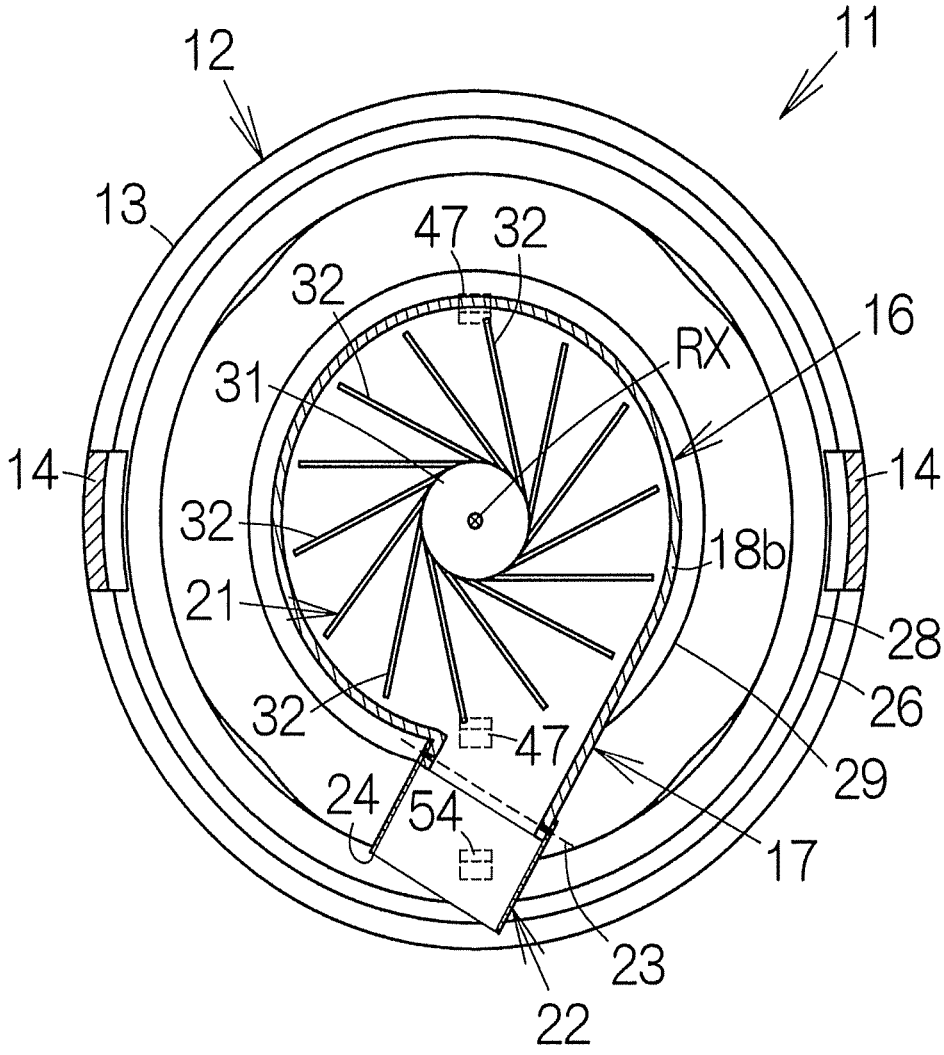
FIG. 4 is a partial transparent plain view for specifying a position of a guide member.

A couple of first guide members 47 are fixed to the bottom panel 18*c* of the housing body 18. FIG. 4 is also referred. FIG. 4 is a partial transparent plain view for specifying a position of the first guide members 47. One of the first guide members 47 and the other guide members 47 are separated from each other at the angle of 180 degree around the rotation center axis RX. That is, the couple of the first guide members 47 are located on a virtual straight line in a perpendicular direction to the rotation center axis RX. The first guide members 47 extend toward the surface of the second base 26 from bottom panel 18*c*. For example, a first protrusion part 47*a*, which is a bent end of the first guide member 47, is formed in a centrifugal direction from the rotation center axis RX. The first protrusion part 47*a* is engaged into a first guide groove 48 formed inner surface of the inner peripheral wall 29. The first guide groove 48 is seamlessly formed to the inner peripheral wall 29 around the rotation center axis RX. As described later, the height of the first guide groove 48 from the surface of the second base 26 changes at each angular location around the rotation center axis RX.

Figure 5:
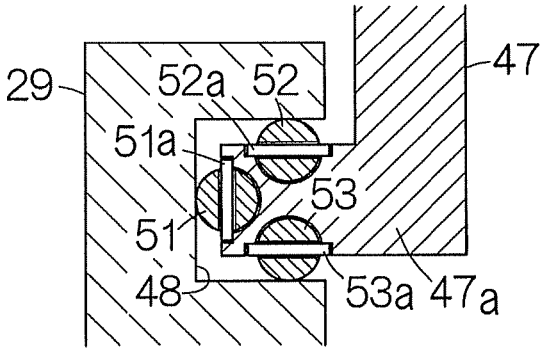
FIG. 5 is a cross-sectional view that schematically illustrates the structure of the wheel built into the guide member.

For example, the first protrusion part 47*a* extends along a virtual plane perpendicular to the rotation center axis RX. FIG. 5 is also referred. FIG. 5 is a cross-sectional view that schematically illustrates the structure of wheels 51, 52, and 53 built into the first guide member 47. For example, sphere-shaped wheels 51, 52, and 53 are built into the side, the top, and the bottom of the first protrusion part 47*a*. The wheel 51 is rotatably built into the first protrusion part 47*a* around a wheel axis 51*a* parallel to the rotation center axis RX. The wheels 52 and 53 are rotatably built into the first protrusion part 47*a* around corresponding wheel axes 52*a* and 53*a* perpendicular to the rotation center axis RX. The wheel 51 is received by the side surface of the first guide groove 48. The wheels 52 and 53 are received by the top surface and the bottom surface of the first guide groove 48. The movement of the first protrusion part 47*a* is guided along the first guide groove 48 on the basis of the rotation of the wheels 51 to 53. The housing body 18 rotates around the rotation center axis RX on the basis of this guide. A positioning mechanism includes the second base 26, the annular inner peripheral wall 29, the first guide member 47 and the first guide groove 48.

A second guide member 54 is fixed on the bottom panel of the exhaust tube 22. The second guide member 54 is located on a virtual straight line that connects the angular positions of the first guide members 47 perpendicular to the rotation center axis RX. The second guide member 54 includes a first member 55 fixed to the exhaust tube 22 and a second member 56 connected with the lower end of the first member 55. The second member 56 relatively rotates to the first member 55 around a second rotation shaft 57 on a virtual plane perpendicular to the rotation center axis RX. A second protrusion part 56*a*, which is a bend end of the second member 56, is formed in a centrifugal direction from the rotation center axis RX. The second protrusion part 56*a* is engaged in a second guide groove 58 formed on the inner surface of the outer peripheral wall 28. The second guide groove 58 is seamlessly formed on the outer peripheral wall 28 around the rotation center axis RX. As described later, the height of the second guide groove 58 from the surface of the second base 26 changes at each angle position around the rotation center axis RX.

For example, the second protrusion part 56*a* extends along a virtual plane perpendicular to the rotation center axis RX. For example, spherical wheels 61, 62, and 63 are built into the side, the top, and the bottom of the second protrusion part 56*a*. The wheel 61 is rotatably built into the second protrusion part 56*a* around a wheel axis (not illustrated) parallel to the rotation center axis RX. The wheels 62 and 63 are rotatably built into the second protrusion part 56*a* around corresponding wheel axes (not illustrated) perpendicular to the rotation center axis RX. The wheel 61 is received by the side surface of the second guide groove 58. The wheels 62 and 63 are received by in the top surface and the bottom surface of the second guide groove 58. The movement of the second protrusion part 56*a* is guided along the second guide groove 58 on the basis of the rotation of these wheels 61 to 63. The exhaust tube 22 swings around the rotation center axis RX on the basis of the guide of the second guide groove 58. A second positioning mechanism includes the second base 26, the outer peripheral wall 28, and the second guide member 54 and the second guide groove 58.

The support grooves 27 have the same height from the surface of the first base 13. For example, spherical wheels 65, 66, and 67 are built in the side surface, the top surface, and the bottom surface of the support groove 27. The wheel 65 is rotatably built into the columns 14 around a wheel axis (not illustrated) parallel to the rotation center axis RX. The wheels 66 and 67 are rotatably built into the columns 14 around corresponding wheel axes (not illustrated) perpendicular to the rotation center axis RX. The wheel 65 is received by the side surface of the support groove 27. The wheel 66 and 67 are received by the top surface and the bottom surface of the support groove 27. The rotation of the second base 26 is guided along the support groove 27 on the basis of the rotation of these wheels 66 to 67. The second base 26 rotates around the rotation center axis RX on the basis of the guide of the support groove 27.

A second electric motor 68 is fixed to the first base 13. A third rotation shaft 69 of the second electric motor 68 is connected with the second base 26. The center axis of the third rotation shaft 69 agrees with the rotation center axis RX. The second electric motor 68 drives the third rotation shaft 69 to rotate. The second base 26 rotates relative to the first base 13 around the rotation center axis RX on the basis of the rotation of the third rotation shaft 69. Here, the rotation of the first base 13 around the rotation center axis RX is restricted as the first base 13 has a relatively large weight. For example, the rotational speed of the second electric motor 68 is set to the rotational speed that allows the second base 26 to achieve several rotations a minute. However, the rotation speed of the second electric motor 68, that is, the rotational speed of the second base 26 is set to be different from the rotational speed of the housing 17.

Figure 6:
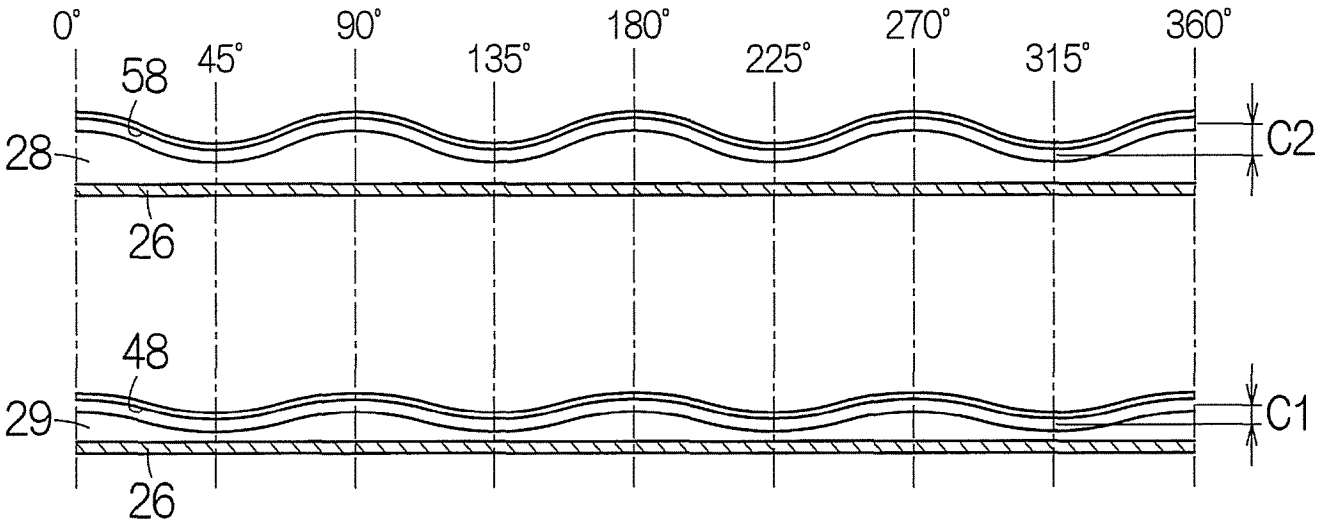
FIG. 6 is a development side view that schematically illustrates the structure of a guide groove.

FIG. 6 schematically illustrates the structures of the first guide groove 48 and the second guide groove 58 according to one embodiment. The first guide groove 48 and the second guide groove 58 are formed into a meandering shape around the rotation center axis RX. For example, the first guide groove 48 and the second guide groove 58 have the same phase in an angular range of 0 degree to 360 degree around the rotation center axis RX. Furthermore, the first guide groove 48 and the second guide groove 58 have the height of the maximum value from the surface of the second base 26, for example, in an angular range of 0 (360), 90, 180 and 270 degrees. Meanwhile, for example, the first guide groove 48 and the second guide groove 58 have the height of the minimum value from the surface of the second base 26 in an angular range of 45, 135, 225 and 315 degrees. Therefore, the height of the first guide groove 48 and the second guide groove 58 decreases gradually from the maximum value in the angular position 0 degree toward a minimum value in the angular position 45 degree. Similarly, the height of the first guide groove 48 and the second guide groove 58 increases gradually from the minimum value in the angular position 45 degree toward a maximum value in the angular position 90 degree.

The same height is set when phase of 90 to 180 degrees, phase of 180 to 270 degrees or phase of 270 to 360 degrees is same phase as phase of 0 to 90 degrees. Thus, four mountains and four valleys are formed in the direction of height from the surface of the second base 26 in the first guide groove 48 and the second guide groove 58. As illustrated in FIG. 6, the change amount C1 of the height of the first guide groove 48 from the maximum value to the minimum value is set smaller than the change amount C2 of the height of the second guide groove 58 from the maximum value to the minimum value. The height on the top side of the inner peripheral wall 29 and the height on the top side of the outer peripheral wall 28 changes at each angle position around the rotation center axis RX according to the first guide grooves 48 and the second guide groove 58. The height on the top side follows to the height of the first guide groove 48 and the second guide groove 58. The height from the surface of the second base 26 to the first guide groove 48 and the height from the surface of the second base 26 to the second guide groove 58 are not limited to the above-mentioned embodiment.

As illustrated in FIG. 3 mentioned above, the first guide member 47 is positioned to the maximum height at the angular position of 0, 90, 180, and 270 degrees. As a result, the first guide member 47, that is, the housing body 18 is located at the uppermost position. The first guide member 54 is also located at the uppermost position, since the first guide groove 48 and the second guide groove 58 have the same phase each other in the angular range of 0 to 360 degrees around the rotation center axis RX. At this time, the exhaust tube 22 is maximally upward positioned on the basis of the swing around the swinging shaft 23. For example, the outer edge of the top panel of the exhaust tube 22 is located above a virtual plane including the top panel 18*a* of the housing body 18. As a result, the outlet 24 is located maximally in the upward direction.

Figure 7:
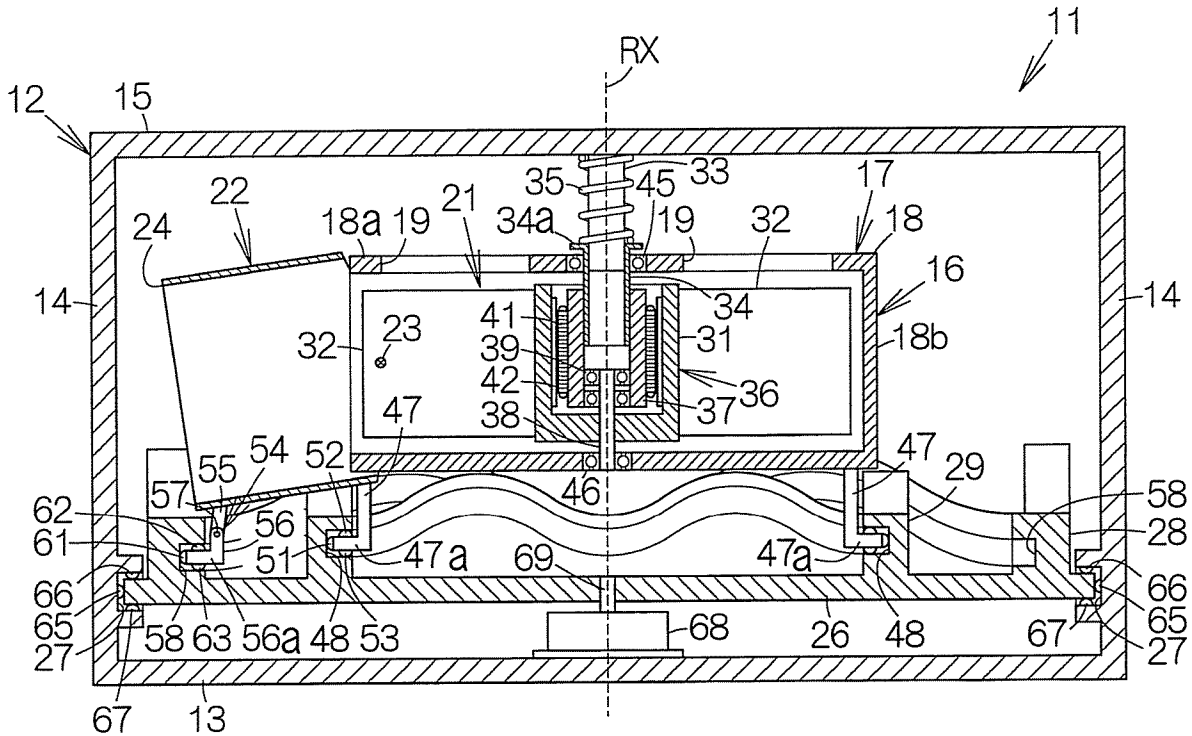
FIG. 7 is a cross-sectional view corresponding to FIG. 3 that schematically illustrates that the housing is positioned at a lowermost position.

FIG. 7 is a cross-sectional view corresponding to FIG. 3 that schematically illustrates that the housing 17 is positioned at a lowermost position. Meanwhile, as illustrated in FIG. 7, the first guide member 47 is positioned to the minimum height from the surface of the second base 26 at the angular position of 45, 135, 225, and 315 degrees. As a result, the first guide member 47, that is, the housing body 18 is located at the lowermost position. Similarly, the second guide member 54 is located at the lowermost position. At this time, the exhaust tube 22 is maximally downward positioned on the basis of the swing around the swinging shaft 23. For example, the outer edge of the bottom panel of the exhaust tube 22 is located under a virtual plane including the bottom panel 18*c* of the housing body 18. As a result, the outlet 24 is located maximally in the downward direction.

As illustrated in FIG. 7, a first member 55 of the second guide member 54 is fixed to the bottom panel of the exhaust tube 22, and make a change in position according to a change in the direction of the exhaust tube 22. As a result, comparing with the case that the second guide member 54 is located at the uppermost position, the second rotation shaft 57 located at the end of the first member 55 approaches to the rotation center axis RX. A second member 56 maintains vertical position on the basis of swinging around the second rotation shaft 57. At this time, the second protrusion part 56*a* of the second member 56 approaches to the rotation center axis RX. Therefore, the inside diameter of the outer peripheral wall 28 is set to the minimum value at the angular position of 45, 135, 225 and 315 degrees. Meanwhile, the inside diameter of the outer peripheral wall 28 is set to the maximum value at the angular position of 0, 90, 180 and 270 degrees.

Figure 8:
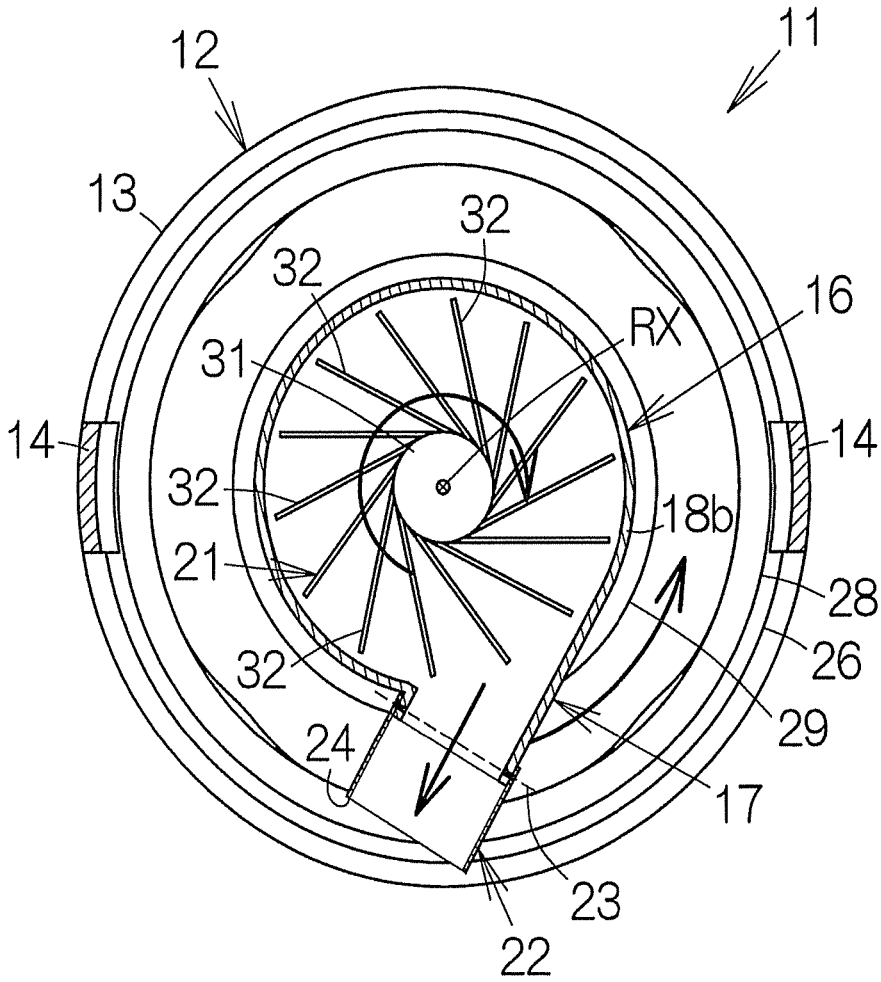
FIG. 8 is a cross-sectional view corresponding to FIG. 2 that schematically illustrates rotation of an impeller and the housing.

A scene where the first blower fan unit 11 operates is assumed now. The first blower fan unit 11 is arranged, for example, at a floor in a data center or on the top panel of the rack for a server computer device set up in the data center. The impeller 21 and the second base 26 rotate when the electric power is supplied to the first electric motor 36 and the second electric motor 68 for the operation of the first blower fan unit 11. The air is flowed into the inlet 19 along the rotation center axis RX on the basis of the rotation of the impeller 21. FIG. 8 is a cross-sectional view corresponding to FIG. 2 that schematically illustrates the rotation of the impeller 21 and the housing 17. As illustrated in FIG. 8, for example, the impeller 21 rotates clockwise. The air current is generated in the centrifugal direction by the rotation of the impeller 21. The air current in the centrifugal direction is induced to the outlet 24 along the inner wall surface of the enclosure wall 18*b*. The air current is exhausted from the outlet 24.

As the housing 17 is rotatably connected to the pipe 34 and the first rotation shaft 38, the housing 17 rotates counterclockwise in opposite direction to the rotation direction of the impeller 21 around the rotation center axis RX on the basis of the air current exhausted from the outlet 24. Thus, the outlet 24 rotates in a 360 degree circle around the rotation center axis RX. Here, since the rotation of the housing 17 is driven on the basis of the air current, the rotational cycle of the housing 17 is set remarkably smaller than the rotational cycle of the impeller 21. Simultaneously, for example, the second base 26 rotates counterclockwise around the rotation center axis RX on the basis of the drive of the second electric motor 68. The rotation period of the second base 26 is set to the rotation period that is different from the rotation period of the housing 17.

At this time, the first guide member 47 moves in the first guide groove 48 on the basis of the rotation of the housing body 18 around the rotation center axis RX. As the height of the first guide groove 48 changes at each angular position around the rotation center axis, the housing body 18 moves up and down between the uppermost position and the lowermost position along the rotation center axis RX according to the rotation of the housing body 18. Simultaneously, the second guide member 54 moves in the second guide groove 58 on the basis of the swinging of the exhaust tube 22 around the rotation center axis RX. As the height of the second guide groove 58 changes at each angular position around the rotation center axis RX, the exhaust tube 22 changes the direction between upward direction at uppermost position and downward direction at the lowermost position by the swinging of the exhaust tube 22. The change in the direction of the exhaust tube 22 synchronizes up and down movement of the housing body 18. A period of the change of the position of the housing body 18 agrees with a period of the change of the direction of exhaust tube 22.

As a result, the air current is exhausted through the outlet 24 in a 360 degree circle around the rotation center axis RX. At this time, the air current is exhausted at a wide range in the upward direction and downward direction along the rotation center axis RX, as the exhaust tube 22 concurrently turns in the upward direction or in the downward direction when the housing body 18 moves up and down along the rotation center axis RX. Moreover, as the rotation period of the second base 26 is different from the rotation period of the housing 17, the direction of the air current changes variously at each angular position in every one rotation of the housing 17. Thus the air current is more effectively stirred around the first blower fan unit 11. And excessive increase in temperature inside the data center is prevented. As a result, for example, the load of the air-conditioning machine set up at the data center is reduced.

Figure 9:
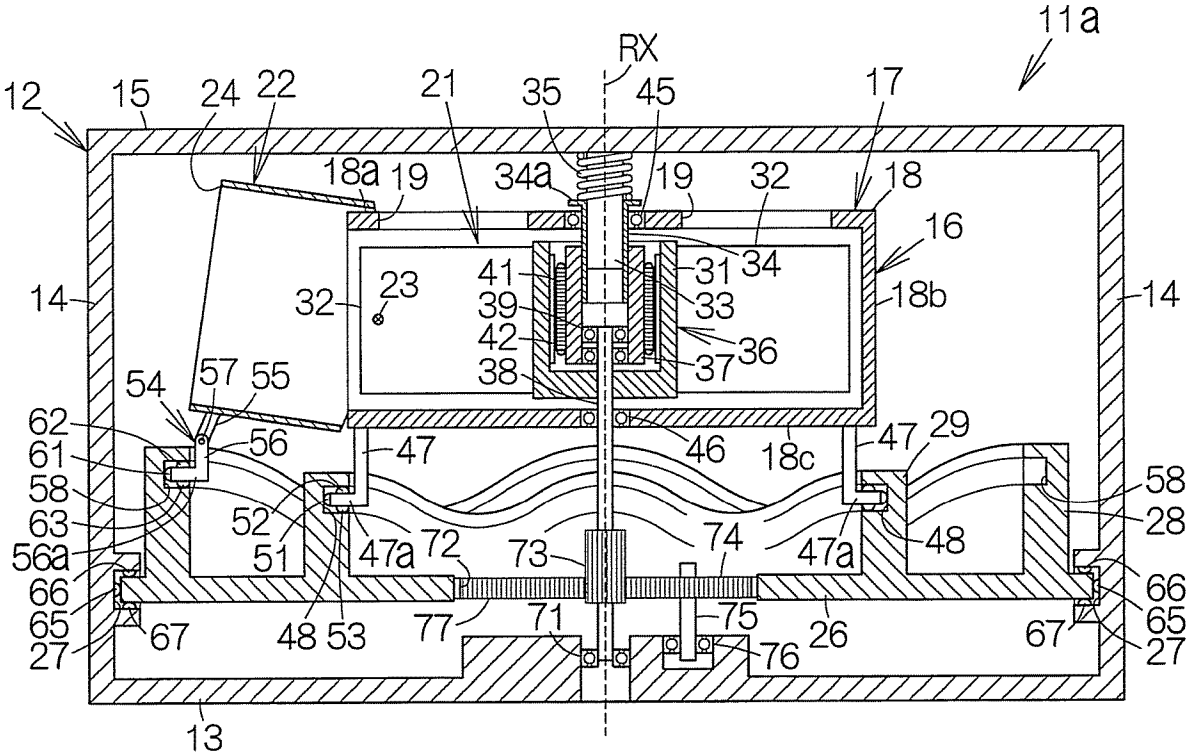
FIG. 9 is a perspective view that schematically illustrates the structure of a blower fan unit according to a second embodiment.

FIG. 9 schematically illustrates the structure of a second blower fan unit 11*a* according to a second embodiment. This second blower fan unit 11*a* does not have the second electric motor 68 connected with the second base 26. Meanwhile, the bottom part of the first rotation shaft 38 of the first electric motor 36 is rotatably supported by the first base 13 on the basis of a fourth ball bearing 71 built into the first base 13. The fourth ball bearing 71 allows the displacement of the first rotation shaft 38 along the rotation center axis RX. The first rotation shaft 38 is located, for example, in a circular shaped penetration hole 72 formed in the second base 26. A center axis of the penetration hole 72 agrees with the rotation center axis RX. A first cogwheel 73 is fixed to the first rotation shaft 38. The first cogwheel 73 is formed to a long cylinder shape along the rotation center axis RX. The first cogwheel 73 rotates around the rotation center axis RX according to the rotation of the first rotation shaft 38.

Figure 10:
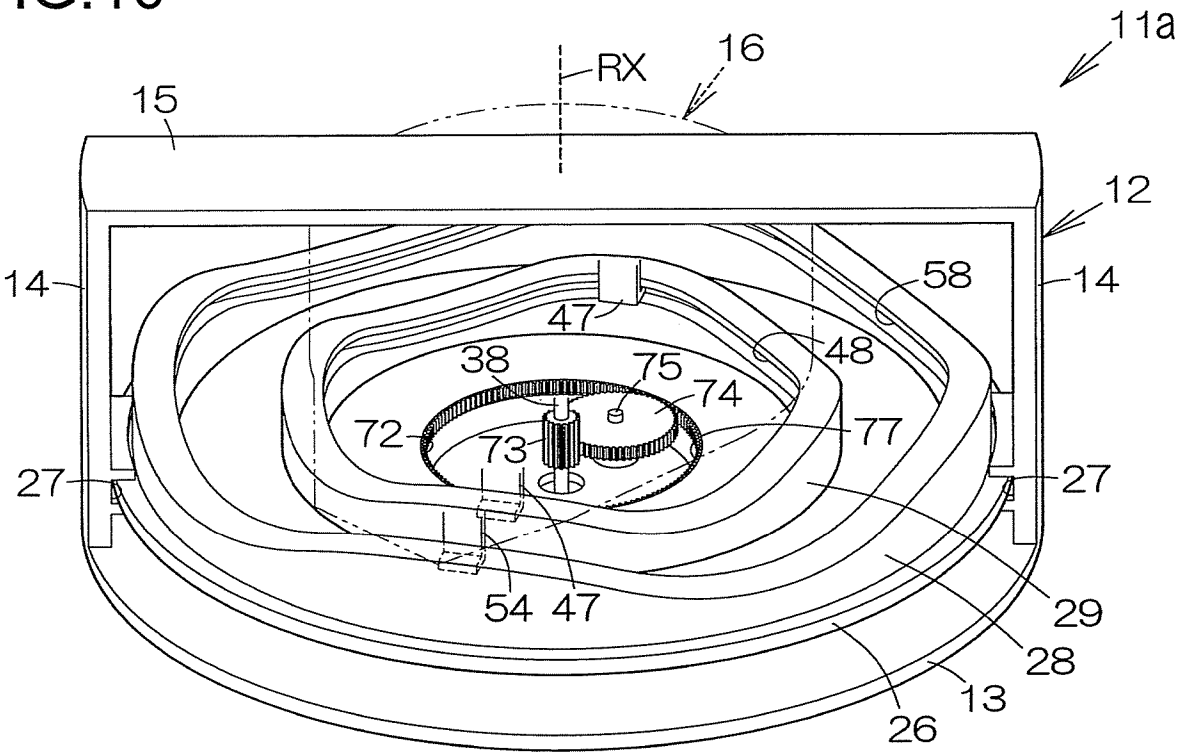
FIG. 10 is a partial transparent perspective view that schematically illustrates the structure of the blower fan unit according to the second embodiment.

FIG. 10 is also referred. FIG. 10 is a partial transparent perspective view that schematically illustrates the structure of the second blower fan unit 11*a* according to the second embodiment. A second cogwheel 74 mounted in the penetration hole 72 engages in the first cogwheel 73. The second cogwheel 74 is fixed to a fourth rotation shaft 75 to stand from the surface of the first base 13. The fourth rotation shaft 75 extends in parallel with the first rotation shaft 38. The fourth rotation shaft 75 is rotatably supported by the first base 13 on the basis of a fifth ball bearing 76 built into the first base 13. For example, the number of the teeth of the second cogwheels 74 is set more than the number of teeth of the first cogwheels 73. The second cogwheel 74 engages in a third cogwheel 77 which is formed to the inner surface the penetration hole 72. The number of teeth of the third cogwheels 77 is set more than the number of teeth of the second cogwheels 74. According to the setting of the number of the teeth, the rotational speed of the second base 26 decelerates greatly compared with the rotational speed of the first rotation shaft 38. Additionally, the same reference numerals are given to the constitution and the structure corresponding to the above-mentioned first blower fan unit 11.

Figure 11:
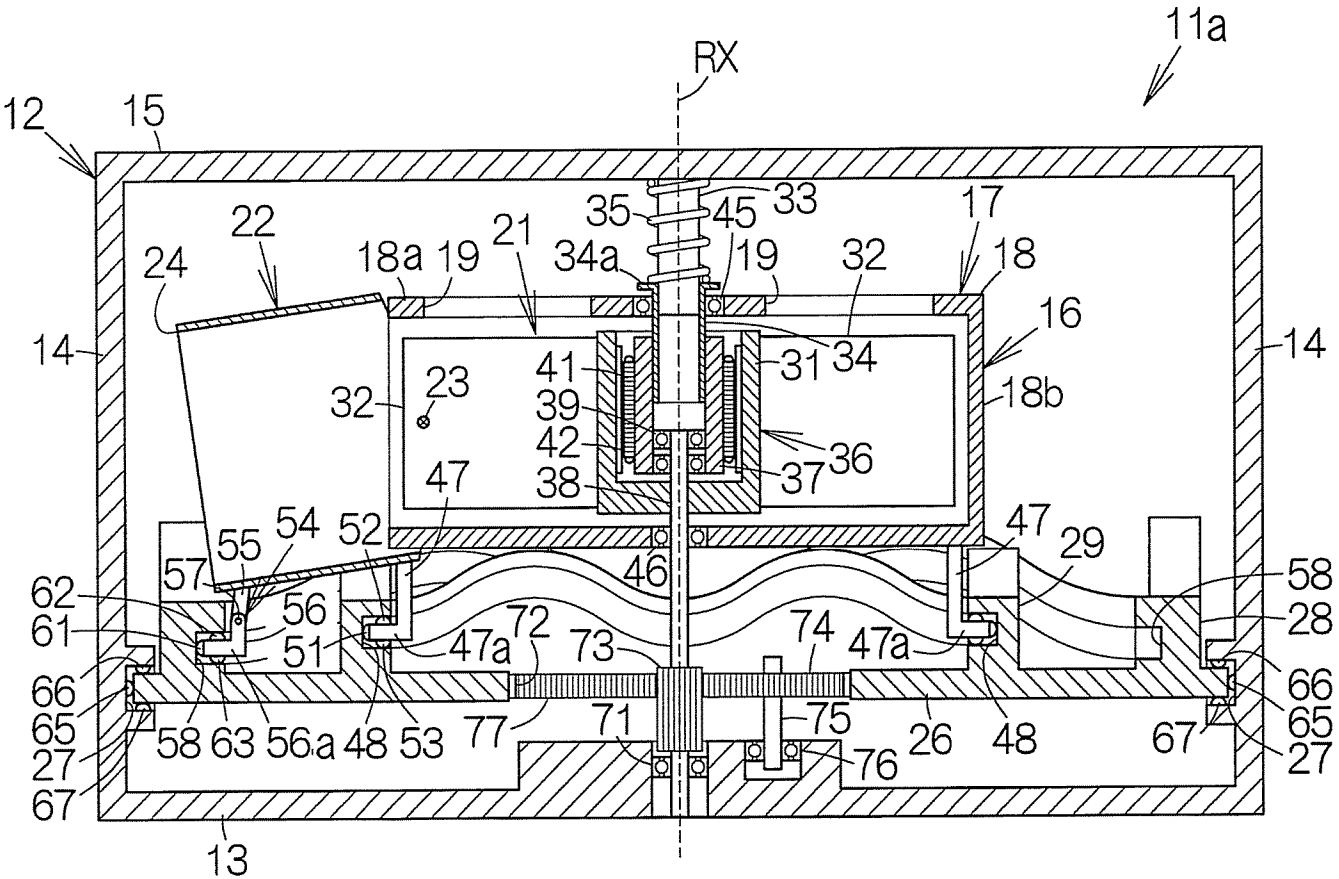
FIG. 11 is a cross-sectional view that schematically illustrates that the housing is positioned at a lowermost position.

When the electric power is supplied to the first electric motor 36 for the operation of the second blower fan unit 11*a*, the air current in the centrifugal direction is exhausted through the outlet 24 on the basis of the rotation of the impeller 21. The housing 17 rotates in the opposite direction to the direction of the rotation of the impeller 21 around the rotation center axis RX on the basis of the air current. Simultaneously, the first cogwheel 73 rotates on the basis of the rotation of the first rotation shaft 38. The driving performance of the first cogwheel 73 is transmitted to the third cogwheel 77 through the second cogwheel 74. FIG. 11 is a cross-sectional view that schematically illustrates that the housing 17 is positioned at a lowermost position. As the first cogwheel 73 is formed in long-scale along the rotation center axis, as illustrated in FIG. 11, the first cogwheel 73 firmly engages in the second cogwheel 74 even if the first rotation shaft 38 moves up and down according to up-and-down movement of the housing 17. The second base 26 rotates counterclockwise around the rotation center axis RX.

As a result, the air current is exhausted through the outlet 24 in a 360 degree circle around the rotation center axis RX. At this time, the air current is exhausted at a wide range in the upward direction and downward direction along the rotation center axis RX, as the exhaust tube 22 concurrently turns in the upward direction or in the downward direction when the housing body 18 moves up and down along the rotation center axis RX. Moreover, as the rotation cycle of the second base 26 is different from the rotation cycle of the housing 17, the direction of the air current changes variously at each angular position in every one rotation of the housing 17. Thus the air current is more effectively stirred around the first blower fan unit 11. And excessive increase in temperature inside the data center is prevented. As a result, for example, the load of the air-conditioning machine set up at the data center is reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A blower fan unit comprising:

a housing;

an impeller rotatable around a rotation center axis to generate an air current in a centrifugal direction from the rotation center axis, the impeller being mounted in the housing;

an outlet formed in the housing and located in a centrifugal direction from the rotation center axis; and a positioning mechanism connected to the housing to make the position of the housing change along the rotation center axis at each angular position around the rotation center axis, wherein the positioning mechanism includes a base having a planar surface perpendicular to the rotation center axis, a peripheral wall standing from the surface of the base around the rotation center axis, a guide member fixed to the housing, and a groove formed in the peripheral wall to guide the movement of the guide member fixed to the housing and to make the height from the surface of the base change at each angular position around the rotation center axis.

2. The unit according to claim 1, wherein the housing includes 1*a* housing body to accommodate the impeller, an exhaust tube swingably connected with the housing body around a rotation shaft that is located on a virtual plane perpendicular to the rotation center axis, the exhaust tube having the outlet, and a second positioning mechanism connected with the exhaust tube to make the direction of the exhaust tube change at each angular position around the rotation center axis.

3. The unit according to claim 2, wherein the second positioning mechanism includes a second peripheral wall standing from the surface of the base around the rotation center axis, a second guide member fixed to the exhaust tube, and a second groove formed in the second peripheral wall to guide the movement of the second guide member fixed to the exhaust tube and to make the height from the surface of the base change at each angular position around the rotation center axis.

4. The unit according to claim 3, further comprising a support stand to swingably support the base around the rotation center axis.

5. The unit according to claim 3, wherein the rotational speed of the base around the rotation center axis is different from the rotational speed of the housing around the rotation center axis.

6. The unit according to claim 3, further comprising:

a first cogwheel engaged in the rotation shaft of the impeller;

a second cogwheel engaged in the first cogwheel; and a third cogwheel formed in the base and engaged in the second cogwheel.

7. The unit according to claim 3, wherein a period of change of the position of the housing body agrees with a period of change of the direction of the exhaust tube.

8. The unit according to claim 2, wherein a period of change of the position of the housing body agrees with a period of change of the direction of the exhaust tube.

9. The unit according to claim 1, further comprising a support stand to swingably support the base around the rotation center axis.

10. The unit according to claim 1, wherein the rotational speed of the base around the rotation center axis is different from the rotational speed of the housing around the rotation center axis.

11. The unit according to claim 1, further comprising:

a first cogwheel engaged in the rotation shaft of the impeller;

a second cogwheel engaged in the first cogwheel; and a third cogwheel formed in the base and engaged in the second cogwheel.

12. A blower fan unit comprising:

a housing body;

an impeller rotatable around a rotation center axis to generate an air current in a centrifugal direction from the rotation center axis, the impeller being mounted in the housing;

an exhaust tube located in a centrifugal direction from the rotation center axis and swingably connected around a rotation shaft on a virtual plane perpendicular to the rotation center axis; and a positioning mechanism connected to the exhaust tube to make the direction of the exhaust tube change around the rotation shaft at each angular position around the rotation center axis.

13. A blower fan unit comprising:

a housing;

an impeller rotatable around a rotation center axis to generate an air current in a centrifugal direction from the rotation center axis, the impeller being mounted in the housing;

an outlet formed in the housing and located in a centrifugal direction from the rotation center axis; and a positioning mechanism connected to the housing to make the position of the housing change along the rotation center axis at each angular position around the rotation center axis, the housing including:

a housing body to accommodate the impeller, an exhaust tube swingably connected with the housing body around a rotation shaft that is located on a virtual plane perpendicular to the rotation center axis, the exhaust tube having the outlet, and a second positioning mechanism connected with the exhaust tube to make the direction of the exhaust tube change at each angular position around the rotation center axis.

* * * * *

UNITED STATES PATENT AND TRADEMARK OFFICE

CERTIFICATE OF CORRECTION

PATENT NO. : 8,485,777 B2
APPLICATION NO. : 12/719941
DATED : July 16, 2013
INVENTOR(S) : Motohiro Takemae et al.

It is certified that error appears in the above-identified patent and that said Letters Patent is hereby corrected as shown below:

In the Claims:

Line 12, Column 10, In Claim 2, delete "1a" and insert -- a --, therefor.

Signed and Sealed this
Twenty-ninth Day of October, 2013

Teresa Stanek Rea
*Deputy Director of the United States Patent and Trademark Office*